United States Patent [19]

Sayles

[11] Patent Number: 4,638,739

[45] Date of Patent: Jan. 27, 1987

[54] SABOT FOR AN ELECTROMAGNETICALLY-ACCELERATED, UNGUIDED HYPERVELOCITY PENETRATOR

[75] Inventor: David C. Sayles, Huntsville, Ala.

[73] Assignee: The United States of America as represented by the Secretary of the Army, Washington, D.C.

[21] Appl. No.: 829,339

[22] Filed: Feb. 14, 1986

[51] Int. Cl.[4] ..... F42B 13/16
[52] U.S. Cl. ..... 102/520
[58] Field of Search ..... 102/520–523, 102/503

[56] References Cited

U.S. PATENT DOCUMENTS

| | | | |
|---|---|---|---|
| 3,769,912 | 11/1973 | Friend | 102/522 |
| 3,961,580 | 6/1976 | Burnett, Jr. et al. | 102/520 |
| 4,177,733 | 12/1979 | Romer et al. | 102/503 |

*Primary Examiner*—Harold J. Todor
*Attorney, Agent, or Firm*—Freddie M. Bush; James T. Dateon

[57] ABSTRACT

A sabot arrangement for launching a penetrator from an electromagnetic accelerator and including a forward sabot that is made of a multiplicity of segments with the segments being made of electrical and thermal insulating material and a base sabot that includes a metal shell made of three integral parts with a cap of electrical and thermal insulating material for insulating the shell structure from the launch tube of an electomagnetic accelerator.

6 Claims, 4 Drawing Figures

SABOT FOR AN ELECTROMAGNETICALLY-ACCELERATED, UNGUIDED HYPERVELOCITY PENETRATOR

DEDICATORY CLAUSE

The invention described herein may be manufactured, used, and licensed by or for the Government for governmental purposes without the payment to me of any royalties thereon.

CROSS REFERENCE TO RELATED APPLICATION

This application is related to applicant's co-pending application Ser. No. 841,086 filed Feb. 18, 1986 in that this invention provides sabot structure for a projectile of the type disclosed in applicant's co-pending application.

BACKGROUND OF THE INVENTION

In the past, various missiles have been provided with sabots for the launching thereof; however, prior art sabots have not been found to have the structural integrity as well as other structural needs for launching a conically-shaped penetrator which is launched from an electromagnetic accelerator that has a square bore or barrel.

Therefore, it is an object of this invention to provide a sabot for launching a conically-shaped penetrator from an electromagnetic accelerator.

Another object of this invention is to provide a sabot construction that is of a two-piece construction with a base sabot and a forward sabot.

Still another object of this invention is to provide a sabot that is constructed to withstand very high actual pressure which is channeled through its structure and transmitted into the base of a penetrator.

Yet another object of this invention is to provide a sabot that utilizes materials that are adequately elastic or viscoelastic to minimize blowby of plasma.

A further object of this invention is to provide a sabot that provides electrical and thermal insulation at the penetrator's base.

Other objects and advantages of this invention will be obvious to those skilled in this art.

SUMMARY OF THE INVENTION

In accordance with this invention, a sabot arrangement is provided for launching a penetrator from an electromagnetic accelerator with the sabot including two sabot sections with a first section of the sabot near the front of the penetrator and a second sabot section at a rear end of the penetrator with the first sabot section comprising four segments that are spring biased outwardly and curvelinear from the penetrator and the second sabot section having a particular structure for mounting and telescoping into an end portion of the projectile and for electrically insulating the metal dome portion of the rear sabot.

DESCRIPTION OF THE PREFERRED EMBODIMENT

Figure 1:
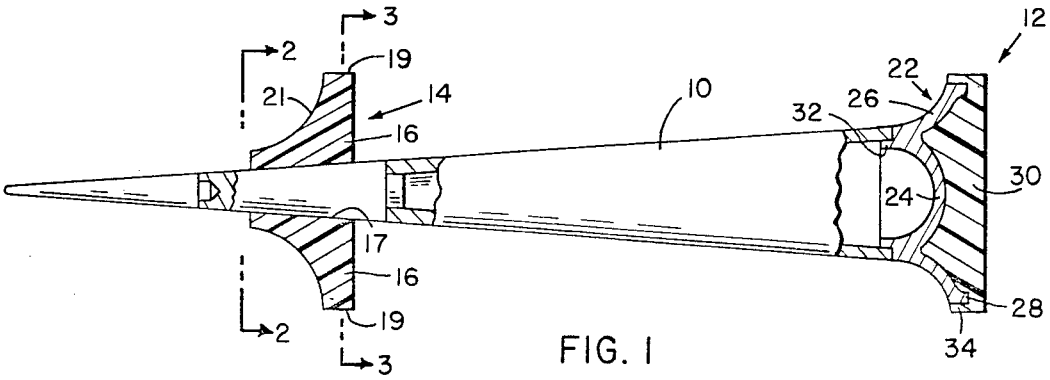
FIG. 1 is a side view partially in section of a penetrator with a sabot arrangement in accordance with this invention.

Referring now to the drawings, a sabot arrangement is provided for use with conically-shaped penetrators 10 which are launched from electromagnetic accelerators (not illustrated) which are fitted with a square bore or barrel. These types of accelerators have been accorded major development attention. These accelerators have two 90° generally U-shaped copper rails (not shown) which face one another. The smallest, workable spaced apart diameter for these rails which can withstand the large electric currents, the severe thermal environment, the high magnetic loads and the mechanical loads has been determined to be about 6 cm.

The disparity between a square-bore of the electromagnetic accelerator and conical-shaped penetrator 10 is compensated for by the use of a sabot arrangement in accordance with this invention. From several considerations, especially due to the necessity of minimum weight, the sabot arrangement in accordance with this invention is of two-piece construction, namely, a base sabot 12 and a forward sabot 14.

Base sabot 12 is constructed so that it is able to withstand the very high axial pressure which is channeled through its structure, and transmitted into the base of penetrator 10 where it is transformed into a very high base load.

There are several other major functions that the sabot satisfies. These are:

a. guide the penetrator 10 at its base with minimum friction;

b. be adequately elastic, or viscoelastic, to minimize blowby of plasma;

c. provide electrical and thermal insulation at the penetrator's base;

d. transform the base pressure into a ring load which then functions to propel penetrator 10 down the launcher tube.

The role of forward sabot 14 is to act as a front guide for penetrator 10.

As a result, the sabot arrangement that has been developed for this application is a two-piece sabot because of the vast differences in their basic functions, and because of the lighter weight.

Figure 2:
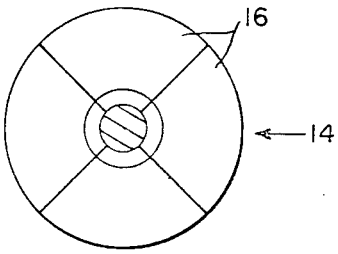
FIG. 2 is a sectional view taken along line 2—2 of FIG. 1.
Figure 3:
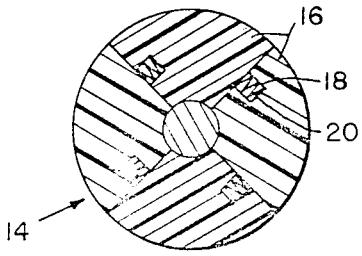
FIG. 3 is a sectional view taken along line 3—3 of FIG. 1.
Figure 4:
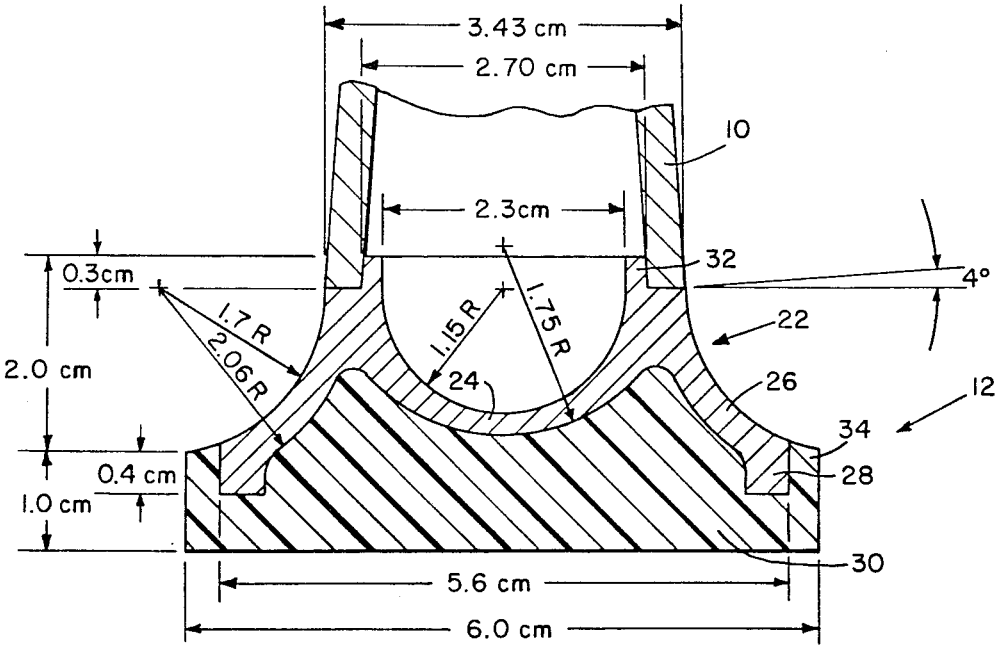
FIG. 4 is a sectional view illustrating the details of the rear sabot section with its dimensions.

FIGS. 1 through 4 show the details of the configurations and materials used in the two segments of the sabot. Forward sabot 14 consists of four equal segments 16 that are made of an electrical and thermal insulating material which is an injection moldable engineering thermoplastic of a poly (amide-imide) resin such as TORLON 4203L produced by AMOCO. This sabot section is designed in a configuration which offers maximum contact area at 17 with penetrator 10, with adequate material distribution to sustain the contact forces and its configurational stability at 19 as it traverses the bore of the launcher. These shapes, including radially outwardly curved and toroidal shaped surface 21, ensure the symmetrical separation of the sabot's four sections 16. To facilitate separation of segments 16, each sabot section 16 has a bore 18 therein with a spring 20 therein to act as a spring-triggered control surface between each of the sabot sections (radially and outward) which, upon separation from the penetrator, act to force the sabot segments into a curved flight trajectory and, thus, to clear the space around the launch tube for the next penetrator which is to be launched.

Base sabot 12 is composed of two different materials. On the forward side, it has an articulated, moderately thick shell 22, made of titanium alloy, which has a tensile strength of 190,000 psi and a shear strength of 130,000 psi and a rear cap 30 of electrical and thermal insulating material.

A suitable titanium alloy is Bata 3 and includes by weight percent 78% Ti, 11.5% Mo, 6% Zr and 4.5% Sn.

Articulated sabot shell 22 consists of three integral parts; namely, a central spherical dome 24 of variable thickness, a toroidal shell section 26 of uniform thickness extending outside of the penetrator's base, and a hoop ring 28 to support the edge of toroidal shell section 26. Spherical section 24 of the shell has a stepped portion 32 that is telescoped into hollow penetrator 10 to curb relative side motions of the penetrator. Rear cap 30 fits over the rear end of sabot shell 22 and provides an outer ring portion 34 around the outer surface of hoop ring 28. Rear cap 30 is made of the same electrical and thermal insulating resin as segments 16 of sabot section 14 to provide electrical and thermal insulation for sabot shell 22 relative to the launch tube from which the penetrator is to be launched. Accordingly, the rear end of penetrator 10 is electrically and thermally insulated from the launch tube by cap 30 and the front end of penetrator 10 is electrically and thermally insulated from the launch tube by segments 16.

In operation, when the sabot is mounted to a penetrator such as penetrator 10 and launched from the launch tube of an electromagnetic accelerator, as the projectile exits the launch tube, segments 16 are caused to radiate from the projectile due to forces acting on surface 21 and due to the action of springs 20. Also, when rear base sabot 12 exits the launch tube, it separates from pentrator 10 due to high drag forces acting thereon. At this point, penetrator 10 is in free flight to its target.

I claim:

1. A sabot arrangement for supporting a conically shaped penetrator for launching from a launch tube, said sabot arrangement comprising a forward sabot comprised of a multiplicity of equal segments having a center bore section for engaging the outer surface of the penetrator, and said segments being made of electrical and thermal insulating material, said sabot arrangement also including a base sabot that includes a metallic shell that includes three integral parts that are connected to form a unitary structure and are composed of a central spherical dome, an intermediate toroidal shell section and an outer hoop ring for supporting an outer edge of the toroidal shell section, and a rear cap fitted over the rear end of a portion of said toroidal shell section, said spherical dome and said hoop ring, said cap being made of electrical and thermal insulating material and said dome having a portion for engaging an end of the penetrator for connection thereto.

2. A sabot arrangement as set forth in claim 1, wherein said segments of said forward sabot have an outer surface that faces generally forward and curves radially outward in a toroidal shape, said material of said segments being a poly (amide-imide) resin, said material of said cap being a poly (amide-imide) resin, and said metallic shell being made of a material that has a tensile strength of about 190,000 psi and a shear strength of about 130,000 psi.

3. A sabot arrangement as set forth in claim 2, wherein said spherical dome has a stepped diameter portion for telescoping into the rear end of the penetrator.

4. A sabot arrangement as set forth in claim 3, wherein said spherical dome has a variable thickness that increases in thickness from a center point radially outwardly.

5. A sabot arrangement as set forth in claim 4, wherein said toroidal shell section has a uniform thickness.

6. A sabot arrangement as set forth in claim 5, wherein said metallic shell is made of a titanium alloy.

* * * * *